US008293697B2

(12) United States Patent
Boutique et al.

(10) Patent No.: US 8,293,697 B2
(45) **Date of Patent: *Oct. 23, 2012**

(54) STRUCTURED FLUID DETERGENT COMPOSITIONS COMPRISING DIBENZYLIDENE SORBITOL ACETAL DERIVATIVES

(75) Inventors: Jean-Pol Boutique, Gembloux (BE); James Charles Theophile Roger Burckett St. Laurent, Brussels (BE); Myriam Bouilliche, Strombeek-Bever (BE); Dennis Allen Beckholt, Fairfield, OH (US); Sohan Rajpanth Murthy, Cincinnati, OH (US); Mario Elmen Tremblay, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,024

(22) Filed: Mar. 16, 2010

(65) Prior Publication Data

US 2010/0240569 A1 Sep. 23, 2010

Related U.S. Application Data

(60) Provisional application No. 61/161,314, filed on Mar. 18, 2009, provisional application No. 61/167,611, filed on Apr. 8, 2009.

(51) Int. Cl.
*C11D 1/02* (2006.01)
*C11D 1/83* (2006.01)
*C11D 3/20* (2006.01)
*C11D 3/386* (2006.01)

(52) U.S. Cl. ..... 510/342; 510/300; 510/320; 510/351; 510/356; 510/392; 510/505; 8/137

(58) Field of Classification Search ..... 510/300, 510/320, 342, 351, 356, 392, 505; 8/137
See application file for complete search history.

(56) References Cited

U.S. PATENT DOCUMENTS

| | | | | |
|---|---|---|---|---|
| 6,855,680 | B2 | 2/2005 | Smerznak et al. | |
| 2004/0162226 | A1 * | 8/2004 | Sunder et al. | 510/220 |
| 2005/0107273 | A1 * | 5/2005 | Hourigan | 510/147 |
| 2005/0203213 | A1 | 9/2005 | Pommiers et al. | |

FOREIGN PATENT DOCUMENTS

| | | | |
|---|---|---|---|
| WO | WO 99/61571 | * | 2/1999 |
| WO | WO 00/34426 | * | 6/2000 |
| WO | WO 00/34426 A2 | | 6/2000 |

OTHER PUBLICATIONS

International Search Report dated May 25, 2010 containing 15 pages.

* cited by examiner

*Primary Examiner* — Brian P Mruk
(74) *Attorney, Agent, or Firm* — Melissa G Krasovec; Leonard W Lewis

(57) ABSTRACT

Fluid detergent compositions comprising from about 0.01% to about 1% by weight of an external structurant comprising dibenzylidene sorbitol acetal derivatives for providing desired rheological benefits such as product thickening, shear thinning behavior, as well as particle suspension capabilities.

18 Claims, No Drawings

STRUCTURED FLUID DETERGENT COMPOSITIONS COMPRISING DIBENZYLIDENE SORBITOL ACETAL DERIVATIVES

CROSS REFERENCE TO RELATED APPLICATIONS

This application claims priority to U.S. Provisional Application Ser. No. 61/161,314, filed Mar. 18, 2009; and U.S. Provisional Application Ser. No. 61/167,611, filed Apr. 8, 2009.

BACKGROUND OF THE INVENTION

The use of external structurants for providing rheological benefits to fluid detergent compositions is known. Examples of desired benefits include particle suspension, shear thinning properties, a thick appearance on the shelf, as well as stabilization of materials which are desired to be incorporated within the composition. See e.g. U.S. Pat. No. 6,855,680 to Smerznak et al. and U.S. Patent Appl. Nos. 2005/203213 to Pommiers et al.

Known external structurants include those such as those derived from castor oil, a fatty acid, fatty ester, or fatty soap water-insoluble waxes. These external structurants have been reported to be useful at levels up to 10% by weight. However, formulating these structurants requires making water-rich premixes and further, the structurant in the premix requires emulsification, making for a complex manufacturing process. In view of the current trend to concentrated detergent compositions, it would be desirable to identify a structurant, and a process, which do not introduce appreciable quantities of water into a detergent composition. Moreover, many structurants are susceptible to degradation by conventional detergent ingredients, such as by hydrolysis, or by enzyme breakdown. Of the structurants which are capable of withstanding such degradation, many do not provide sufficient rheological benefits at low levels, such as below 1 wt %. As such, there is an ongoing need for an external structurant which is not subject to such degradation, but capable of providing the desired rheological benefits at low levels.

Additional problems encountered with many known structurants is that a certain amount of water that must be incorporated with such structurants in raw material form, increasing transportation cost and processing complexities; difficulties forming liquid having the properties of gel, such as a shear thinning gel, a gel capable of suspending particles, and/or a thixotropic gel. In certain instances thixotropic gels may be desired for localized delivery of a liquid detergent composition. Another problem encountered with known structurants is obtaining the desired rheological properties in a liquid while using relatively low amounts of structurant.

SUMMARY OF THE INVENTION

One aspect of the present invention relates to a fluid detergent composition comprising a fluid detergent comprising: from about 0.01% to about 70% by weight of a surfactant system comprising an anionic surfactant, a nonionic surfactant or a mixture thereof; from about 0.01% to about 1% by weight of a dibenzylidene sorbitol acetal derivative; and a composition pH of from about 2 to about 7.

Another aspect of the present invention relates to a process of making a fluid detergent composition comprising the steps of: forming a premix comprising a structurant comprising a dibenzylidene sorbitol acetal derivative and an organic carrier; and combining the premix with a detergent feed, said detergent feed comprising an anionic surfactant.

Yet another aspect of the present invention relates to the use of the fluid detergent composition or the premix comprising an external structurant comprising dibenzylidene sorbitol acetal derivative and an organic carrier within a fluid laundry detergent composition.

Yet another aspect of the present invention relates to the use of fluid detergent compositions having the properties of a thixotropic gel. In a further aspect, said liquid detergent composition can have a low water content such as disclosed herein. Such as low water content composition can be incorporated into an article of use comprising the liquid detergent composition and a substrate, wherein the substrate may include a water-soluble film.

DETAILED DESCRIPTION OF THE INVENTION

Definitions

As used herein, "fluid" as used herein includes liquids, gels, foams, mousse, and any other flowable non-gas phased composition. Non-limiting examples of fluids within the scope of this invention includes light duty and heavy duty liquid detergent compositions, detergent gels commonly used for laundry, and bleach and laundry additives. Gases, e.g., suspended bubbles, may be included in the compositions.

As used herein, the term "compositions" are intended to include laundry product forms which can be marketed for use as complete, general-purpose heavy-duty laundry detergents, as well as other known laundry product forms. Such forms include those known in the market place as "laundry additives", which are typically not used alone, but rather, can be used in combination with and/or in a sequence of laundering steps, with other detergent products so as to improve overall laundering. Such laundry forms can be exemplified by laundry bleaches, laundry bleach additives or laundry bleach boosters; laundry pre-treaters; "stain pen" or "stain stick" formulations, laundry product formulations that can be combined with a substrate, e.g., a "wet wipe" or patch, and laundry product forms suitable for dispensing by automatic dosing devices. Additional cleaning benefits obtainable from such laundry product forms include improved whiteness and/or blueing of fabrics; improved localized stain removal; control of mites, bacteria or general hygiene, and the like. Moreover, the laundry product compositions of the invention can include all ingredients in a single compartment, e.g., a normal bottle made from a water-insoluble plastic or a pouch made from a water-soluble polymer such as PVA; or can separate ingredients into different compartments, e.g., in a dual-compartment bottle or in a dual or multi-compartment sachet such as one made of water-soluble or dispersible plastics such as polyvinyl alcohol.

As used herein, "fluid matrix" means the fluid portion of the composition excluding any non-soluble particulate components and excluding air bubbles.

As used herein, the composition pH is the pH measurement of the fluid detergent. pH measurement is carried out after diluting the composition with deionized water, at a concentration of the composition in water of 1% by weight. In one embodiment, the composition pH of the present invention is from about 2 up to about 7, alternatively up to or at least about 3, up to or at least about 4, up to or at least about 5, or up to or at least about 6, as measured at 1% by weight in deionized water. In this embodiment, the composition preferably contains a bleach such as hydrogen peroxide and/or is a bleach containing additive suitable for laundry cleaning. In another embodiment the compositional pH can be from about 6 up to about 10.5, alternatively from about 7 to about 9. This pH range is suitable for fully formulated laundry detergent compositions which are typically used as complete laundry detergents.

As used herein, "essentially free" of a component means that no amount of that component is deliberately incorporated into the composition.

As used herein "suspension beads and/or particles" includes solid beads, capsules either empty or containing functional or non-functional ingredients therein, microcapsules, particles, and fragments thereof. "Plurality of suspension particles" includes both suspension beads and particles which can form from suspension beads which have broken apart.

As used herein, a "structurant" is any material which is added to the composition to provide rheological and structuring benefits, for example as measured by yield stress. As used herein, "external structurant" means a material which has as its primary function that of providing rheological alteration to the fluid detergent. Generally, therefore, an external structurant will not, in and of itself, provide any significant cleaning benefits or any significant ingredient solubilization benefits. As is known in the art, detergent surfactants may in function of their level in fluid detergents, exhibit structuring properties. Structurants as defined herein do not include such detergent surfactants.

"Soluble" as used herein means that more than nine tenths of the formulated agent actually dissolves in the fluid detergent composition. As used herein, the term "water-soluble" means having a water-solubility of from about 50 wt % to about 100 wt % as measured by the method disclosed herein in the section entitled "Test Methods." As used herein, the term "water-insoluble" means that the solubility may be less than about 50 wt % as measured according to the method disclosed herein in the section entitled "Test Methods." As used herein, "cold water solubility" is intended to mean that the material is from about 90% to about 100% soluble in water having temperatures of about 5° C. to about 30° C. as measured according to the method disclosed herein in the section entitled "Test Methods." As used herein, "hot water solubility" is intended to mean that the material is from about 90% to about 100% soluble in water having temperatures of up to about 60° C. As used herein, the term "water dispersible" refers to a substrate that will, with sufficient time, break apart into smaller pieces, when placed in an aqueous environment. As a result, the structure once dispersed may be more advantageously processable in recycling processes or flushable in, for example, septic and municipal sewage treatment systems.

By "internal structuring" it is meant that the detergent surfactants, which form a major class of laundering ingredients, are relied on for structuring effect. It is known in the art to structure fluid detergents internally.

As used herein, the term "external structurant" refers to a selected compound or mixture of compounds which provides structure to a detergent composition independently from, or extrinsic from, any structuring effect of the detersive surfactants of the laundering composition. Structuring benefits include arriving at yield stresses suitable for suspending particles having a wide range of sizes and densities. External structurants useful herein have chemical identities set out in detail hereinafter. Without intending to be limited by theory, many external structurants are believed to operate by forming threadlike or needle-like solid structures in the laundry composition. Suitable external structurants may be chiral or non-chiral. Mixtures of enantiomers can be used but when the external structurant is chiral, it may be preferred, for improved structuring, to employ a substantially pure stereoisomer. However, such preference may need to be balanced against the generally higher cost of pure optical isomers.

All measurements and calculations are conducted at 25° C. unless otherwise specified.

1. External Structurant a. Dibenzylidene Sorbitol Acetal Derivative ("DBS")

In one embodiment, the fluid detergent composition comprises from about 0.01% to about 1% by weight of a DBS, alternatively from about 0.05% to about 0.8%, alternatively from about 0.1% to about 0.6%, alternatively from about 0.3% to about 0.5%. It has importantly been found that the certain types of DBS derivatives to fluid detergent compositions at low levels, such as below 0.7%, alternatively below about 0.5%, alternatively below about 0.4%, is still capable of providing sufficient rheological benefits such as thickening and gelling. Without intending to be bound by theory, it is believed that DBA derivatives having relatively low solubility in the final detergent composition (as compared to other structurants) are particularly suitable for facilitating thickening and gelling at said levels. DBS derivatives with lower solubility in the detergent matrix will tend to form more robust structures and to gel the detergent composition faster, especially at lower DBS level. It is believed that benefits to having low levels of external structurant include costs benefits as well as formulation flexibility as other actives can be included at higher levels if needed.

It has been found that the addition of DBS to fluid detergent compositions results in a fluid detergent composition with the desired rheological properties without being undesirably sensitive to the presence of conventional fluid detergent compositions such as detergent enzymes.

In one embodiment the DBS derivative is selected from the group consisting of: 1,3:2,4-dibenzylidene sorbitol; 1,3:2,4-di(p-methylbenzylidene) sorbitol; 1,3:2,4-di(p-chlorobenzylidene) sorbitol; 1,3:2,4-di(2,4-dimethyldibenzylidene) sorbitol; 1,3:2,4-di(p-ethylbenzylidene) sorbitol; and 1,3:2,4-di(3,4-dimethyldibenzylidene) sorbitol. These and other suitable DBS derivatives are disclosed in U.S. Pat. No. 6,102,999 to Cobb et al. at col. 2, line 43-col. 3, line 65. In one embodiment, the DBS derivative comprises: a mono(3-chloro-4-methylbenzylidene)-D-sorbitol; a mono(3,4-dimethoxybenzylidene)-D-sorbitol; a mono(3-ethyl-4-methylbenzylidene)-D-sorbitol; a mono(3-methyl-4-ethylbenzylidene)-D-sorbitol; a mono(3-propyl-4-methylbenzylidene)-D-sorbitol; a mono(3,4-diethylbenzylidene)-D-sorbitol; a mono(3,4-dichlorobenzylidene)-D-sorbitol; a mono(3,4-dimethylbenzylidene)-D-sorbitol; a mono(3,4-dipropylbenzylidene)-D-sorbitol; a mono(3,4-diethoxybenzylidene)-D-sorbitol; a mono(3,4-diisopropoxybenzylidene)-D-sorbitol and like sorbitol derivatives; a mono(3-ethyl-4-methylbenzylidene)-xylitol, a mono(3-methyl-4-ethylbenzylidene)-xylitol, a mono(3-propyl-4-methylbenzylidene)-xylitol, a mono(3,4-diethylbenzylidene)-xylitol, a mono(3,4-dichlorobenzylidene)-xylitol, a mono(3,4-dimethylbenzylidene)-xylitol, a mono(3,4-dipropylbenzylidene)-xylitol, a mono(3-chloro-4-methylbenzylidene)-xylitol, a mono(3,4-dimethoxybenzylidene)-D-xylitol and like xylitol derivatives, and mixtures thereof. In another embodiment, the DBS derivative has the formula:

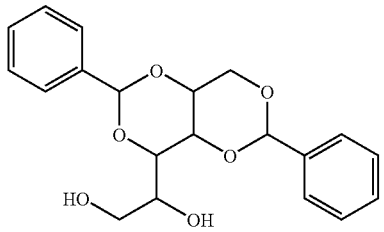

Varying the substituents of the DBS permit the formulator to increase or decrease the dissolution temperature of the DBS in low-water premixes. Lower processing temperatures are advantageous, e.g., for thermally sensitive materials such as enzymes, in making the present fluid detergent composition. On the other hand, in one preferred embodiment the DBS derivatives which have higher dissolution temperatures in low to nil water premixes (such as from about 0% to about 10%) may have other advantages, such as improved gel stability on storage.

Further, another advantage to using DBS derivatives at the low levels as disclosed herein is that the desired rheological benefits can be obtained without undesirable formation of residues after the wash/rinse process. Gellants have been described for use in various other types of compositions such as bar soaps and stick deodorants. See e.g. U.S. Pat. Nos. 7,045,491, and 6,514,919. It is believed, however, that these types of soaps and stick deodorants typically leave residues or films when contacted on fabrics. The present invention, however, has found that DBS derivatives can be used in sufficiently low levels to provide the desired rheological benefits without the undesirable formation of films and residues on the treated surfaces such as fabrics and laundry. Further, another benefit obtained by using DBS is that clear compositions can be obtained with sufficient thickness, and shear thinning behavior, and particle suspension capabilities without the fluid matrix being opaque or undesirably cloudy.

It has been found the suitable rheological benefits can be achieved with surprisingly low levels of the DBS derivative, for example, wherein said fluid detergent comprises less than about 0.5% by weight of said DBS derivative, alternatively, less than about 0.4%, alternatively, less than about 0.3%. In one embodiment, the external structurant further comprises an additional dibenzylidene polyol derivative selected from the group consisting of ribitol deriviatives, xylitol deriviatives, tartrate derivatives, threitol derivatives and mixtures thereof. In one embodiment, the fluid detergent is essentially free of any additional dibenzylidene polyol derivative, particularly free of the threitol derivative.

b. Secondary External Structurants

It is believed that the DBS derivative may not provide the desired rheological benefits to the fluid composition until the DBS derivative has had time to settle and gel in the fluid detergent. This phenomenon can be remedied by the addition of a secondary external structurant which may be able to provide the desired rheological benefits while the DBS derivative is gelling. As such, in one embodiment of the present invention, in addition to the DBS derivative structurant, the fluid detergent composition comprises a secondary external structurant. Non-limiting examples of suitable secondary structurants are listed below:

i. Bacterial Cellulose

In one aspect, the fluid detergent composition further comprises from about 0.005% to about 1.0% of an bacterial cellulose network, alternatively less than about 0.125%, alternatively less than about 0.05%, alternatively less than about 0.01%, alternatively at least about 0.01%, alternatively at least about 0.05%, by weight of said fluid detergent composition. The term "bacterial cellulose" is intended to encompass any type of cellulose produced via fermentation of a bacteria of the genus *Acetobacter* and includes materials referred popularly as microfibrillated cellulose, reticulated bacterial cellulose, and the like. The bacterial cellulose utilized herein may be of any type associated with the fermentation product of *Acetobacter* genus microorganisms, and was previously available, one example, from CPKelco U.S. is CELLULON®. Such aerobic cultured products are characterized by a highly reticulated, branching interconnected network of fibers that are insoluble in water.

*Acetobacter* is characteristically a gram-negative, rod shaped bacterium 0.6-0.8 microns by 1.0-4 microns. It is a strictly aerobic organism; that is, metabolism is respiratory, not fermentative. This bacterium is further distinguished by the ability to produce multiple poly β-1,4-glucan chains, chemically identical to cellulose. The microcellulose chains, or microfibers, of reticulated bacterial cellulose are synthesized at the bacterial surface, at sites external to the cell membrane. These microfibers have a cross sectional dimensions of about 1.6 nm to about 3.2 nm by about 5.8 nm to about 133 nm. In one embodiment, the bacterial cellulose network has a widest cross sectional microfiber width of from about 1.6 nm to about 200 nm, alternatively less than about 133 nm, alternatively less than about 100 nm, alternatively less than about 5.8 nm. Additionally, the bacterial cellulose network has an average microfiber length of at least 100 nm, alternatively from about 100 to about 1500 nm. In one embodiment, the bacterial cellulose network has a microfiber aspect ratio, meaning the average microfiber length divided by the widest cross sectional microfiber width, of from about 10:1 to about 1000:1, alternatively from about 100:1 to about 400:1, alternatively from about 200:1 to about 300:1. See U.S. Pat. No. 6,967,027 to Heux et al.; U.S. Pat. No. 5,207,826 to Westland et al.; U.S. Pat. No. 4,487,634 to Turbak et al.; U.S. Pat. No. 4,373,702 to Turbak et al. and U.S. Pat. No. 4,863,565 to Johnson et al., U.S. Pat. Publ. No. 2007/0027108 to Yang et al.

ii. Coated Bacterial Cellulose

In one embodiment, the bacterial cellulose which is at least partially coated with a polymeric thickener. This at least partially coated bacterial cellulose can be prepared in accordance with the methods disclosed in U.S. Pat. Publ. No. 2007/0027108 to Yang et al. at pp 8-19. In one embodiment the method of producing said at least partially coated bacterial cellulose comprises a proportion of bacterial cellulose to polymeric thickener comprises from about 0.1% to about 5% of the bacterial cellulose, alternatively from about 0.5% to about 3.0%, by weight of the added polymeric thickener; and from about 10% to about 900% of the polymeric thickener by weight of the bacterial cellulose.

In one embodiment the polymeric thickener comprises a hydrocolloid, at least on charged cellulose ether, at least one polymeric gum, and mixtures thereof. One suitable hydrocolloid includes carboxymethylcellulose ("CMC"). Suitable polymeric gums comprises xanthan products, pectin, alginates, gellan gum, welan gum, diutan gum, rhamsan gum, carageenan, guar gum, agar, gum Arabic, gum ghatti, karay gum, gum tragacanth, tamarind gum, locust bean gum, and the like and mixtures there: See U.S. Pat. Publ. No. 2007/0027108 at pp 6 and 16.

In another embodiment, the bacterial cellulose is non-coated and undergoes no further modified either chemically or physically aside from the activation and/or the polymeric thickener coating.

iii. Non-Polymeric Crystalline Hydroxyl-Functional Materials Other than DBS or Threitols Another suitable secondary structurant comprises a non-polymeric (except for conventional alkoxylation), crystalline hydroxyl-functional material, which forms thread-like structures throughout the fluid detergent when crystallized within the matrix in situ. Such materials can be generally characterized as crystalline, hydroxyl-containing fatty acids, fatty esters or fatty waxes. See e.g. U.S. Pat. No. 7,169,741 at col. 9, line 61 to col. 11, line 4, and U.S. Pat. No. 6,080,708 and in WO Publ. No. 2002/0040627. These materials have significant disadvantages, compared to the essential DBS materials, in that they are either subject to degradation by enzymes, or they are substantially less effective as gelling agents than the DBS derivatives.

The crystalline, hydroxyl-containing stabilizing agent may be present in the fluid detergent compositions at a level of from about 0.1% to about 5%, more typically from about 0.1% to about 3%, most typically from about 0.3% to about 2% by weight of the fluid detergent composition. Crystalline, hydroxyl-containing stabilizing agents can be fatty acid, fatty ester or fatty soap water-insoluble wax-like substance. The crystalline, hydroxyl-containing stabilizing agents may be derivatives of castor oil, especially hydrogenated castor oil derivatives, for example, castor wax. Some crystalline, hydroxyl-containing stabilizing agents are described in detail in U.S. Pat. No. 6,855,680.

iv. Polymeric Structuring Agents

Suitable types of polymeric structuring agent includes: organic thickeners such as: acrylic polymers, synthetic non-ionic polymers, urethanes, synthetic cationic polymers, celluloses, and gums; and inorganic thickeners. These polymeric structuring agents are disclosed in detail in *Surfactant Science Series* vol. 129, Chapter 5, pages 144-169, Taylor and Francis, (2006), titled "Rheology Modifiers for Liquid Detergents."

Other suitable secondary structurants include polymeric structuring agents. Polymeric structuring agents that will provide shear-thinning capabilities to the fluid detergent may also be employed. Suitable polymeric structuring agents include those of the polyacrylate, polysaccharide or polysaccharide derivative type. Polysaccharide derivatives typically used as structuring agents comprise polymeric gum materials. Such gums include pectine, alginate, arabinogalactan (gum Arabic), carrageenan, gellan gum, xanthan gum and guar gum. Gellan gum is a heteropolysaccharide prepared by fermentation of Pseudomonaselodea ATCC 31461 and is commercially marketed by CP Kelco U.S., Inc. under the KELCOGEL tradename. Processes for preparing gellan gum are described in U.S. Pat. Nos. 4,326,052; 4,326,053; 4,377,636 and 4,385,123. Other potential secondary structurants include inorganic salts and clays as known in the art.

In one aspect, the external structuring system may be free or essentially free of any additional structuring agent known in the art such as those listed herein, bacterial celluloses, non-polymeric crystalline hydroxyl-functional materials, and/or polymeric structuring agents including polymeric gums, pectine, alginate, arabinogalactan (gum Arabic), carrageenan, gellan gum, xanthan gum and guar gum. It has importantly been found that the external structuring system disclosed herein provides sufficient rheological benefits, such as particle suspension and shear thinning capabilities, without reliance on the secondary structurant.

2. Optional Detersive Enzymes

In one embodiment, the fluid detergent compositions of the present invention optionally comprise from about 0.0001% to about 5% by weight of a detersive enzyme, preferably from about 0.001 to about 2%, more preferably from about 0.01 to about 1%. In another embodiment the level of detersive enzyme is from about 0.0001% to about 8% by weight or more (depending on activity of commercial enzyme preparations) of a detersive enzyme, alternatively from about 0.001 to about 5%, alternatively from about 0.01 to about 1% or, in another aspect, from about 0.01% to about 2%. In one preferred embodiment, the detersive enzyme comprises a lipase enzyme. In another preferred embodiment, the detersive enzyme comprises lipase in combination with protease, amylase and cellulase or xyloglucanase. In yet another preferred embodiment, the detersive enzyme comprises lipase in combination with protease, amylase and pectate lyase. Without intending to be bound by theory, it is believed that lipase enzyme functions to help in cleaning by breaking ester bonds in stains and dirt. It has importantly been found that the DBS derivative is not susceptible to degradation in the presence of lipase enzyme. It is believed that this is due to the lack of ester bonds present in the DBS derivative.

In one aspect, the enzyme may comprise a lipase having E.C. classification 3.1.1.3, as defined by EC classification, IUPAC-IUBMB and genetically modified variants thereof possessing at least about 90%, at least about 95%, at least about 98%, or at least about 99%, or 100% identity with said lipase. In one aspect, said lipase and variants thereof are derived from the wild-type *Humicola Lanuginosa*. In one aspect, the lipase is a variant of the wild-type lipase from *Thermomyces lanuginosus* comprising the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Exemplary lipases are available from Novozymes as Lipolase®, Lipolase Ultra®, Lipolex®, Lipoprime® and Lipex®.

For purposes of the present invention, the degree of identity between two amino acid sequences is determined using the Needleman-Wunsch algorithm (Needleman and Wunsch, 1970, J. Mol. Biol. 48: 443-453) as implemented in the Needle program of the EMBOSS package (EMBOSS: The European Molecular Biology Open Software Suite, Rice et al., 2000, Trends in Genetics 16: 276-277; http://emboss.org), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the –nobrief option) is used as the percent identity and is calculated as follows:

$$(\text{Identical Residues} \times 100)/(\text{Length of Alignment} - \text{Total Number of Gaps in Alignment})$$

For purposes of the present invention, the degree of identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra; http://emboss.org), preferably version 3.0.0 or later. The optional parameters used are gap open penalty of 10, gap extension penalty of 0.5, and the EDNAFULL (EMBOSS version of NCBI NUC4.4) substitution matrix. The output of Needle labeled "longest identity" (obtained using the –nobrief option) is used as the percent identity and is calculated as follows:

(Identical Deoxyribonucleotides×100)/(Length of Alignment−Total Number of Gaps in Alignment)

More generally, any other lipases of bacterial or fungal origin can be used. Chemically modified or protein engineered mutants are included. Examples of such lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas lipase*, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g. from *B. subtilis* (Dartois et al. (1993), Biochemica et Biophysica Acta, 1131, 253-360), *B. stearothermophilus* (JP 64/744992) or *B. pumilus* (WO 91/16422). Other lipase variants are those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202. Other suitable lipases are disclosed by Svedsen in U.S. Pat. No. 5,869,438.

The detersive enzyme of the present invention can be present in the fluid detergent and/or can be encapsulated. Where the detergent enzyme is encapsulated, there is still a likelihood that the detersive enzyme can leach or otherwise escape the encapsulating material and therefore affect any enzyme sensitive ingredients present in the fluid detergent, such as the structurants in the composition.

In a one aspect, the composition may comprise one or more additional detersive enzymes which provide cleaning performance benefits. Said additional detersive enzymes include enzymes selected from cellulases, endoglucanases, hemicellulases, peroxidases, proteases, gluco-amylases, amylases, cutinases, pectinases, xylanases, reductases, oxidases, phenoloxidases, lipoxygenases, ligninases, pullulanases, tannases, pentosanases, malanases, β-glucanases, arabinosidases, mannanases, xyloglucanases or mixtures thereof. A preferred combination is a fluid detergent composition having a cocktail of conventional applicable enzymes like protease, amylase, lipase, cutinase, mannanases, xyloglucanases and/or cellulase. Enzymes when present in the compositions, at from about 0.0001% to about 5% of active enzyme by weight.

Known cellulases include endoglucanase (E.C.3.2.1.4) enzyme produced by *Bacillus* sp. AA349 such as CELLUCLEAN® as well as CELLUZYME from Novozymes. Additional cellulase enzymes suitable for use in the present invention include those disclosed in WO Publ. 2004/053039A2, WO Publ. 2002/099091A2, U.S. 2004/0002431A1, U.S. Pat. No. 4,945,053, and U.S. Pat. No. 4,978,470. Additional endoglucanase enzymes which can be used in accordance with the present invention include xyloglucanases such as disclosed in WO0162903A1 to Novozymes.

In one aspect, the compositions and methods of the present invention may include a protease enzyme from about 0.0001% to about 5%, specifically from about 0.001% to about 2%, more specifically from about 0.001% to about 1%, even more specifically from about 0.001% to about 0.2%, even more specifically still from about 0.005% to about 0.1%, by weight of a protease enzyme. Any protease suitable for use in detergents can be used. Such proteases can be of animal, vegetable or microbial origin, with both modified (chemical or genetically variants) and unmodified proteases included.

One class of suitable proteases include the so-called serine endopeptidases [E.C. 3.4.21] and an example of which are the serine protease [E.C. 3.4.21.62]. Illustrative non-limiting examples of serine proteases includes subtilisins, e.g. subtilisins derived from *Bacillus* (e.g. *B. subtilis, B. lentus, B. licheniformis, B. amyloliquefaciens, B. alcalophilus*), for example, subtilisins BPN and BPN', subtilisin Carlsberg, subtilisin 309, subtilisin 147, subtilisin 168, subtilisin PB92, their mutants and mixtures thereof.

Illustrative non-limiting examples of commercially available serine proteases, include, Alcalase®, Savinase®, Kannase®, Everlase® available from Novozymes; Purafect®, Purastar OxAm®, Properase® available from Genencor; BLAP and BLAP variants available from Henkel; and K-16-like proteases available from KAO. Additional illustrative proteases are described in e.g. EP130756, WO91/06637, WO95/10591, WO99/20726, U.S. Pat. No. 5,030,378 (Protease "A") and EP251446 (Protease "B").

Examples of commercial α-amylases products are Purafect Ox Am® from Genencor and Termamyl®, Termamyl Ultra® Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. The mannanase can be selected from the group consisting of: three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase and mixtures thereof. (IUPAC Classification—Enzyme nomenclature, 1992 ISBN 0-12-227165-3 Academic Press).

Alternatively, the compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactoglucomannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

In one aspect, the compositions may comprise the DBS derivative as external structurant, at least one suspended particle, lipase and an enzyme stabilizer. Suitable enzyme stabilizers are known in the art.

3. Surfactant System

The fluid detergent can be made for any suitable cleaning purpose, including but not limited to: heavy duty and light duty laundry detergent. As such, the surfactant system is selected based on the desired application. Suitable surfactants include any conventional surfactants known for use with the above cleaning purposes.

The fluid detergent composition of the present invention comprises from about 0.01% to 70%, alternatively from about 1% to about 50%, alternatively from about 3% to about 20% by weight of a surfactant system. It has importantly been found that fluid detergents having low levels of surfactant system, such as from about 5% to about 45% by weight, alternatively below 20%, require a structurant to provide the desired rheological properties. Without intending to be bound by theory, it is believed that when formulating fluid detergents with levels of surfactant system below about 45%, alternatively below about 25%, alternatively below about 20%, the low level of surfactant system does not impart adequate internal structuring to the formulation. As a result, when the detergent formulation comprises a low level of surfactant, the addition of DBS as an external structurant is preferred.

More generally the surfactant system of the present compositions it is made up of one, two, or a mixture of three or more distinct surfactant molecular structures, and can be present in the physical state of one or more fluid phases and can be isotropic or nonisotropic. Surfactant phases present can include micellar, lamellar (either L-alpha or L-beta), sponge phases e.g., L3 phase, hexagonal phase or the like. In certain embodiments, the overall composition comprises a mixture of surfactant and solvents which, in the absence of the DBS structurant, would exist as a phase-split mixture which separates into a minimum of two distinct layers on standing. Such phase split mixtures can comprise, for example, in one embodiment, approximately 40% of a surfactant-rich layer on a volume basis, and 60% of a solvent/water rich layer on a volume basis. More generally such phase split mixtures can, for example, comprise from about 1 to about 50% of one or more surfactant-rich layers on a volume basis, and the balance of a solvent/water rich layer and/or lye phases on a volume basis. Very surprisingly, the DBS derivatives selected herein are capable of coupling such layers so that a substantially homogeneous composition results which does not phase split to any significant extent on standing at 20 deg. C. for a period of at least one month.

In one aspect, the surfactant system may comprise anionic surfactant, nonionic surfactant, or a mixture thereof. Additional suitable surfactants include a cationic surfactant; an ampholytic surfactant; a zwitterionic surfactant; and mixtures thereof. Suitable surfactants for use herein are disclosed in, for example, U.S. 2005/0203213 to Pommiers et al., 2004/0018950 to Foley et al. and U.S. Pat. No. 7,169,741 to Barry et al.

Useful anionic surfactants can themselves be of several different types. Anionic surfactants suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, alternatively from 12 to 18 carbon atoms, and wherein the polyethoxylate chain contains from 1 to 15, alternatively 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

In one embodiment, the anionic surfactant is selected from the group consisting of $C_{11}$-$C_{18}$ alkyl benzene sulfonates (LAS), $C_{10}$-$C_{20}$ branched-chain and random alkyl sulfates (AS), $C_{10}$-$C_{18}$ alkyl ethoxy sulfates ($AE_xS$) wherein x is from 1-30, mid-chain branched alkyl sulfates, mid-chain branched alkyl alkoxy sulfates, $C_{10}$-$C_{18}$ alkyl alkoxy carboxylates comprising 1-5 ethoxy units, modified alkylbenzene sulfonate (MLAS), $C_{12}$-$C_{20}$ methyl ester sulfonate (MES), $C_{10}$-$C_{18}$ alpha-olefin sulfonate (AOS), $C_6$-$C_{20}$ sulfosuccinates, and mixtures thereof.

Suitable nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

In one aspect, the composition may comprise a nonionic surfactant selected from the group consisting of C9-C18 alkyl ethoxylates, C6-C12 alkyl phenol alkoxylates, C12-C18 alcohol and $C_6$-$C_{12}$ alkyl phenol condensates with ethylene oxide/propylene oxide block polymers, $C_{14}$-$C_{22}$ mid-chain branched alcohols, $C_{14}$-$C_{22}$ mid-chain branched alkyl alkoxylates, alkylpolyglycosides, polyhydroxy fatty acid amides, ether capped poly(oxyalkylated) alcohols, fatty acid ($C_{12-18}$) sorbitan esters, and mixtures thereof.

Where the composition comprises both anionic and nonionic surfactants, it is preferable to have the wt. % of anionic surfactant exceed the wt. % of nonionic surfactant, alternatively a ratio of about 1:1 to about 100:1, alternatively from about 2:1 to about 25:1. It is believed that having both types of surfactant with a relatively higher amount of anionic surfactant provides for superior fabric cleaning with less residue from the wash/rinse process.

In one embodiment, the fluid detergent comprises a weight ratio of surfactant system to external structurant, i.e. DBS derivative, of from about 1:1 to 5000:1, alternatively from about 10:1 to about 1000:1, alternatively from about 30:1 to about 500:1.

4. Shear Thinning Capabilities

In one aspect, the fluid detergent of the present invention may be a shear thinning fluid, meaning that the fluid detergent has a specific pouring viscosity, a low stress viscosity, and a ratio of these two viscosity values. These viscosities are measured herein by using a TA AR 2000 (or AR G2) rheometer with a 40 mm stainless steel parallel plate having a gap of 500 microns. The pouring viscosity, as defined herein, is measured at a shear rate of 20 $sec^{-1}$. In one aspect, suitable external structuring agents are those which provide a fluid detergent having a pouring viscosity which generally ranges from about 50 to about 20000 cps, alternatively from about 200 to 10000 cps, alternatively from about 500 cps to about 7000 cps. The low stress viscosity, as defined herein, is determined under a constant low stress of 0.1 Pa. The fluid detergent has a low stress viscosity of at least about 1,500 cps, alternatively at least about 10,000 cps, and alternatively at least 50,000 cps. This low stress viscosity represents the viscosity of the fluid detergent under typically usage stress conditions and during transportation and packaging. The low stress viscosity is measured using a TA AR 2000 (or AR G2) rheometer in a low stress viscosity creep experiment over 5 minute intervals. Rheology measurements over the 5 minute interval are made after the rheology of the matrix has recovered completely from any past high-shear events and has rested at zero shear rate for 10 minutes between loading the sample in the rheometer and running the test. The data over the last 3 minutes are used to fit a straight line, and from the slope of this line viscosity is calculated. To exhibit suitable shear-thinning characteristics, in one embodiment, the fluid detergent may have a ratio of low stress viscosity to pouring viscosity value of at least about 1, alternatively at least about 2, alternatively at least about 10, alternatively at least about 100, up to about 2000 or about 1000.

In one aspect, the composition may have the properties of a thixotropic gel. In this aspect, the composition may have a resting viscosity of from about 10,000 to about 500,000, or from about 100,000 to about 400,000, or from about 200,000 to about 300,000, as measured in cps. In another aspect, the compositions having the properties of a thixotropic gel may have a viscosity under shear, such as via the application of manual pressure by the consumer, such that the composition may deliver one or more benefit agents to the fabric. For example, in one aspect, the composition may be capable of penetrating the surface of the fabric under shear, such that the fibers of the fabric may be contacted with the one or more benefit agents.

5. Suspension Particles

In one embodiment, the fluid detergent composition further comprises a plurality of suspension particles at a level of from about 0.01% to about 10% by weight, alternatively from about 0.05% to about 4% by weight, alternatively from about 0.1% to about 3% by weight. Examples of suitable suspension particles are provided in U.S. Pat. No. 7,169,741 to Barry et al. at col. 12-18 and U.S. Patent Publ. No. 2005/0203213 to Pommiers et al., pp 14-60. Examples of suitable suspension particles include liquid core suspension particles, solid core suspension particles, and mixtures thereof. The particles can be selected to provide multiple benefits, for example combinations of perfume microcapsules with other suspension particles can be accomplished simultaneously.

Suspension particles herein can in general be of the non-deformable solid type or can be deformable droplets. Droplets can be combined with solid particles. The suspension particles can have a wide range of aspect ratios, densities, phase structures, refractive indices, polydispersities or of any other useful particle properties. Particles can be monodisperse or polydisperse. Suitable particle size ranges, depending on the effect desired, can range from nano through micro to millimeter scales. As is well known in the art, nanoparticles can result in compositions which appear transparent to the eye, whereas much larger particles can result in compositions which appear to include discrete beads.

a. Liquid Core Suspension Particles

In one embodiment, one or more of the suspension particles have liquid cores. These particles function especially well in terms of stability within the detergent composition prior to use, yet are suitably unstable in the washing liquors formed from such products. In one embodiment the liquid core has an ionically charged polymeric material encapsulated by a semipermeable membrane. This membrane is one which can be formed by interaction of some of the ionically charged polymer in the core with another polymeric material of opposite charge. Nonlimiting examples of suitable liquid core suspension particles are available in U.S. Pat. No. 7,169,741.

b. Solid Core Suspension Particles

Another type of suspension particle which is suitable for use herein includes particles (or beads) with solid cores. In one embodiment, the plurality of suspension particles comprises a friable bead such as disclosed in EP 670 712. One suitable use for such a friable bead is for exfoliation of the skin. Suitable beads or particles for exfoliating can have a particle size in the range of 0.03 to 3 mm. Further, these beads can be friable meaning that during use they break up into particles having an average size of less than 50 microns. In one embodiment, the suspension particle comprises a pearlescence modifier. Suitable pearlescence modifiers include ethylene glycol distearate (EGDS), $TiO_2$, ZnO, Mica and mixtures thereof.

c. Perfume Microcapsules

In one embodiment, the fluid detergent composition comprises a perfume. Perfume is typical incorporated in the present compositions at a level of at least about 0.001%, alternatively at least about 0.01%, alternatively at least about 0.1%, and no greater than about 10%, alternatively no greater than about 5%, alternatively no greater than about 3%, by weight.

In one embodiment, the perfume of the fabric conditioning composition of the present invention comprises an enduring perfume ingredient(s) that have a boiling point of about 250° C. or higher and a ClogP of about 3.0 or higher, alternatively at a level of at least about 25%, by weight of the perfume. Suitable perfumes, perfume ingredients, and perfume carriers are described in U.S. Pat. No. 5,500,138; and US 20020035053 A1.

6. Optional Limited Solubility Agents

The limited solubility agents that need to be stabilized within fluid detergent compositions include agents that have a tendency to phase separate and/or coalesce in the fluid detergent compositions. Nonlimiting examples include limited solubility agents include fabric substantive agents. Examples of fabric substantive agents include silicon-containing agents, such as cationic silicones, nitrogen-containing silicones, such as TUBINGAL® commercially available from Th. Goldschmidt, alternatively polydimethyl siloxanes; fabric substantive perfume agents; anti-abrasion agents, such as carboxymethylcellulose and ethylmethylcellulose; dye fixative agents; optical brighteners; and soil release polymers, dyes, hueing agents, pigments and so forth.

The limited solubility agents are typically present in the fluid detergent compositions of the present invention from about 0.001% to about 20%, more typically from 0.1% to about 8%, most typically from about 0.5% to about 6% by weight of the fluid detergent composition.

a. Silicon-Containing Agents

Nonlimiting examples of useful silicones in the composition of the present invention include noncurable silicones such as polydimethylsiloxane and volatile silicones, and other suitable curable or non-curable silicones such as aminosilicones, phenylsilicones and hydroxysilicones. The word "silicone" as used herein can refer to emulsified silicones, including those that are commercially available and those that are emulsified in the composition, unless otherwise described. Suitable silicones are hydrophobic; are neither irritating, toxic, nor otherwise harmful when applied to fabric or when they come in contact with human skin; are chemically stable under normal use and storage conditions; and are capable of being deposited on fabric. Nonlimiting examples of additional suitable silicones are disclosed in U.S. Pat. No. 6,855,680 to Smerznak et al. Silicones can be dispersed in the present compositions in a wide range of particle sizes, such as from 10 nm to 100 micron or higher.

Silicones that are useful in the fluid detergent compositions of the present invention include polyalkyl and/or phenylsilicones silicone fluids and gums with the following structure:

$$A\text{-}Si(R_2)\text{—}O\text{—}[Si(R_2)\text{—}O\text{—}]_q\text{—}Si(R_2)\text{-}A$$

The alkyl groups substituted on the siloxane chain (R) or at the ends of the siloxane chains (A) can have any structure as long as the resulting silicones remain fluid at room temperature.

Each R group can be alkyl, aryl, hydroxy, or hydroxyalkyl group, and mixtures thereof, alternatively, each R is methyl, ethyl, propyl or phenyl group, alternatively R is methyl. Each A group which blocks the ends of the silicone chain can be hydrogen, methyl, methoxy, ethoxy, hydroxy, propoxy, and aryloxy group, preferably methyl. Suitable A groups include hydrogen, methyl, methoxy, ethoxy, hydroxy, and propoxy. q is preferably an integer from about 7 to about 8,000. The preferred silicones are polydimethyl siloxanes; more preferred silicones are polydimethyl siloxanes having a viscosity of from about 50 to about 1000,000 centistokes at 25° C.

b. Fabric Substantive Perfumes

Fabric substantive perfumes include products of the reaction between a primary and/or secondary amine and one or more active ingredients. The primary and/or secondary amine can be selected from the group consisting of aminoaryl derivatives, polyamines, amino acids and derivatives, substituted amines and amides, glucamines, dendrimers, amino-substituted mono-, di-, oligo-, poly-saccharides and mixtures thereof. The one or more active ingredients which are reacted with the primary and/or secondary amine can be selected from the group consisting of aldehydes, ketones and mixtures thereof.

The reaction product may have an Odor Intensity Index of less than that of a 1% solution of methylanthranilate in dipropylene glycol, a Dry Surface Odor Index of more than 5. Preferably the reaction product is not an aminostyrene. The fabric substantive perfumes typically have a formula selected from the group consisting of: 1) $B\text{—}(NH_2)_n$; 2) $B\text{—}(NH)_n$; and 3) $B\text{—}(NH)_n\text{—}(NH)_n$ wherein B is a carrier material which is preferably an organic carrier (inorganic carriers being less preferred), alternatively the carrier material is an amino functionalized polydialkylsiloxane. WO 00/02991 describes such fabric substantive perfumes in more detail.

c. Anti-Abrasion Agents

Cellulosic based polymer or oligomer materials are suitable for use in the fluid detergent compositions of the present invention. Nonlimiting examples of such materials include carboxymethylcellulose (CMC) and ethylmethylcellulose (EMC). Examples of suitable anti-abrasion agents include those described in U.S. Pat. No. 6,855,680 at col. 10, line 1 to col. 14, line 17.

d. Dye Fixative Agents

Cationic Dye Fixing Agents—The compositions of the present invention optionally comprise from about 0.001%, alternatively from about 0.5% to about 90%, alternatively to about 50%, alternatively to about 10%, alternatively to about 5% by weight, of one or more dye fixing agents. Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Non-limiting examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE ex Sandoz, REWIN SRF, REWIN SRF-O and REWIN DWR ex CHT-Beitlich GMBH; Tinofix® ECO, Tinofix® FRD and Solfin® ex Ciba-Geigy (see WO 99/14301), and CARTAFIX CB® ex Clariant.

Cellulose Reactive Dye Fixing Agents—Another dye fixing agent suitable for use in the present invention are cellulose reactive dye fixing agents. The compositions of the present invention optionally comprise from about 0.01%, alternatively from about 0.05%, alternatively from about 0.5% to about 50%, alternatively to about 25%, alternatively to about 10% by weight, alternatively to about 5% by weight, of one or more cellulose reactive dye fixing agents. The cellulose reactive dye fixatives may be suitably combined with one or more dye fixatives described above to form a "dye fixative system".

The term "cellulose reactive dye fixing agent" is defined herein as "a dye fixative agent which reacts with the cellulose fibers upon application of heat or upon a heat treatment either in situ or by the formulator". Typically cellulose reactive dye fixing agents are compounds which contain a cellulose reactive moiety, non limiting examples of these compounds include halogeno-triazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity. Additional suitable dye fixing agents include those disclosed in U.S. Pat. No. 6,855,680 at col. 14-15.

e. Polymeric Deposition Aids

The compositions of the invention include embodiments comprising a polymeric deposition aid. Polymeric deposition aids serve to improve the deposition of perfume microcapsules, silicones or other fabric benefit agents onto the fabrics being laundered. Polymeric deposition aids may be synthetic or may be derived from materials of natural origin. Preferred polymeric deposition aids are cationic. A highly preferred polymeric deposition aid is cationic hydroxyethylcellulose (CatHEC). Other suitable polymeric deposition aids include cationic guar polymers such as Jaguar (ex Rhone Poulenc), cationic cellulose derivatives such as Celquats (ex National Starch), Flocald (ex National Starch), cationic potato starch such as SoftGel (ex Aralose), cationic polyacrylamides such as PCG (ex Allied Colloids). Cationic polymeric aids are particularly preferred in the absence of any other cationic material in the composition. Additional preferred cationic polymeric deposition aids are described in WO 08/114,226A1 to Depoot and WO 08/114,171A1 to Panandiker et al. Other suitable commercial suppliers include Amerchol and Nalco.

f. Optical Brighteners

Any optical brighteners or other brightening or whitening agents known in the art can be incorporated at levels typically from about 0.01% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, the 2-(4-styryl-phenyl)-2H-naptho[1,2-d]triazoles; 4,4'-bis-(1,2,3-triazol-2-yl)-stilbenes; 4,4'-bis(styryl)bisphenyls; and the amino-coumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

g. Soil Release Agents and/or Soil Suspending Polymers

The compositions according to the present invention may optionally comprise one or more soil release agents and/or soil suspending polymers including anti-redeposition agents. If utilized, soil release agents and/or soil suspending polymers will generally comprise from about 0.01%, alternatively from about 0.1%, alternatively from about 0.2% to about 10%, alternatively to about 5%, alternatively to about 3% by weight, of the composition.

Particularly suitable polyamine polymers for use herein as soil suspending polymers are polyalkoxylated polyamines, such as ethoxylated polyethylene amines, i.e., the polymerized reaction product of ethylene oxide with ethyleneimine, having the general formula:

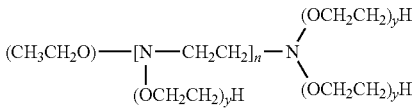

when y=2-30. Particularly preferred for use herein is an ethoxylated polyethylene amine, in particular ethoxylated tetraethylenepentamine, and quaternized ethoxylated hexamethylene diamine.

Alternatively a wide range of other known soil suspending polymers can also be used. In one desirable embodiment, the soil suspending polymer is an amphiphilic graft polymer based on water-soluble polyalkylene oxides as a graft base and side-chains formed by polymerization of a vinyl ester component, said polymer may have an average of less than or equal to one graft site per 50 alkylene oxide units and mean molar mass Mw of from 3000 to 100,000. Such polymers can be introduced into the present formulations either alone or in combination with carriers and/or solvents as described in Boeckh et al, WO 2007/138054A1 incorporated herein by reference. By way of the solvent or carrier used as a vehicle for carrying the polymer into the detergent composition, particular preference is given to alkyoxylation products having a high degree of branching, so that the polymer mixture is free flowing at 40-70 deg. C. The polymer as incorporated into the formula may be in solution or may be in the form of a dispersion of polymer droplets. Other soil suspending polymers commercially available include Sokolan HP-22, available from BASF Corp.

In another preferred embodiment, the compositions comprise a soil suspending polymer having affinity for removing fatty dirt from textiles which is selected from amphiphilic water-soluble alkoxylated polyalkylenimines having an inner polyethylene oxide block comprising 20 to 50 polyethylene oxide units and an outer polypropylene oxide block comprising 10 to 50 polyethylene oxide units and especially to such alkoxylated polyalkylenimines wherein the ratio of polyethylene oxide units and polypropylene oxide units is proportionally related to the square root of the number of polyalkyleneimine units present in the backbone. See Boeckh et al, US20080153983A1.

Soil suspending polymers can be used alone or in combination with known soil release agents Likewise, soil release agents can be used alone or in combination with soil suspending polymers. Suitable soil release agents include those having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments may comprise at least about 25% oxyethylene units and alternatively, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$-$C_6$ alkylene or oxy $C_4$-$C_6$ alkylene segments, or mixtures therein, (iii) poly (vinyl ester) segments, such as polyvinyl acetate), having a degree of polymerization of at least 2, or (iv) $C_1$-$C_4$ alkyl ether or $C_4$ hydroxyalkyl ether substituents, or mixtures therein, wherein said substituents are present in the form of $C_1$-$C_4$ alkyl ether or $C_4$ hydroxyalkyl ether cellulose derivatives, or mixtures therein, and such cellulose derivatives are amphiphilic, whereby they have a sufficient level of $C_1$-$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. See U.S. Pat. No. 4,000,093, to Nicol, et al. Soil release agents characterised by poly(vinyl ester) hydrophobe segments include graft co-polymers of poly(vinyl ester), e.g., $C_1$-$C_6$ vinyl esters, such as poly(vinyl acetate) grafted onto polyalkylene oxide backbones, such as polyethylene oxide backbones. One type of preferred soil release agent is a co-polymer having random blocks of ethylene terephthalate and polyethylene oxide (PEO) terephthalate. The molecular weight of this polymeric soil release agent is in the range of from about 25,000 to about 55,000. Another preferred polymeric soil release agent is a polyester with repeat units of ethylene terephthalate units which contains 10-15% by weight of ethylene terephthalate units together with 90-80% by weight of polyoxyethylene terephthalate units, derived from a polyoxyethylene glycol of average molecular weight 300-5,000. See U.S. Pat. No. 4,702,857. Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. Other suitable polymeric soil release agents include the terephthalate polyesters, the anionic end-capped oligomeric esters, and the block polyester oligomeric compounds. Nonlimiting examples of additional suitable soil release polymers are disclosed U.S. Pat. No. 6,855,680 in section (g) entitled "Soil Release Agents." If utilized, soil release agents will generally comprise from about 0.01% to about 10.0%, by weight, of the compositions herein, typically from about 0.1% to about 5%, alternatively from about 0.2% to about 3.0%.

h. Bleaching Systems

The present compositions can include bleach or be essentially free of bleach. When including bleach in the compositions, preference is given to selecting an oxygen bleach and incorporating the bleach without direct mixing into a premix comprising the DBS derivatives. Other preferred embodiments separate bleach from enzyme, for example by use of compartmentalization in multicompartment unit dose or other suitable types of packaging.

Hydrogen peroxide sources are described in detail in the herein incorporated Kirk Othmer's Encyclopedia of Chemical Technology, 4th Ed (1992, John Wiley & Sons), Vol. 4, pp. 271-300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

Surprisingly in view of the acetal structure of the DBS derivatives, compositions herein which comprise hydrogen peroxide are found to exhibit excellent bleach stability and the DBS itself is stable in such compositions.

(a) Bleach Activators—The peroxygen bleach component in the composition can be formulated with an activator (peracid precursor). The activator is present at levels of from about 0.01%, alternatively from about 0.5%, alternatively from about 1% to about 15%, alternatively to about 10%, alternatively to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, alternatively benzoylcaprolactam and benzoylvalerolactam. Particularly preferred bleach activators in the pH range from about 8 to about 9.5 are those selected having an OBS or VL leaving group.

Examples of additional suitable hydrophobic bleach activators include nonanoyloxybenzenesulphonate (NOBS), 4-[N-(nonaoyl)amino hexanoyloxy]-benzene sulfonate sodium salt (NACA-OBS) (See U.S. Pat. No. 5,523,434), dodecanoyloxy-benzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA). Non-limiting examples of suitable bleach activators include quaternary substituted bleach activators as described in U.S. Pat. No. 6,855,680.

(b) Organic Peroxides, especially Diacyl Peroxides—These are extensively illustrated in Kirk Othmer, Encyclopedia of Chemical Technology, Vol. 17, John Wiley and Sons, 1982 at pages 27-90 and especially at pages 63-72, all incorporated herein by reference. If a diacyl peroxide is used, it will preferably be one which exerts minimal adverse impact on spotting/filming.

(c) Metal-containing Bleach Catalysts—Additional bleach catalysts include manganese and cobalt-containing bleach catalysts. One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Transition Metal Complexes of Macropolycyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, alternatively from about 0.05 ppm to about 500 ppm (wherein "ppb" denotes parts per billion by weight and "ppm" denotes parts per million by weight).

As a practical matter, and not by way of limitation, the compositions and laundry processes herein can be adjusted to provide on the order of at least one part per hundred million of the active bleach catalyst species in the aqueous washing medium, and may provide from about 0.01 ppm to about 25 ppm, or from about 0.05 ppm to about 10 ppm, or from about 0.1 ppm to about 5 ppm, of the bleach catalyst species in the wash liquor. In order to obtain such levels in the wash liquor of an automatic washing process, typical compositions herein will comprise from about 0.0005% to about 0.2%, alternatively from about 0.004% to about 0.08%, of bleach catalyst, especially manganese or cobalt catalysts, by weight of the bleaching compositions.

(d) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate) and U.S. Pat. No. 5,817,614. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

(e) Pre-formed Peroxy Carboxylic acid—The fluid detergent compositions of the present invention may comprise a pre-formed peroxycarboxylic acid (hereinafter referred to as a "peracid"). The preformed peracid compound can be selected from the group consisting of percarboxylic acids and salts, percarbonic acids and salts, perimidic acids and salts, peroxymonosulfuric acids and salts, and mixtures thereof.

The peracids used herein may have a solubility in aqueous fluid detergent compositions measured at 20° C. of from about 10 ppm to about 1500 ppm, alternatively from about 50 ppm to about 1000 ppm, alternatively from about 50 ppm to about 800 ppm solubility is measured at 20° C. In a particularly preferred embodiment of the present invention the peracid has mean average particle size of less than 100 microns, alternatively less than 80 microns, alternatively less than 60 microns. Alternatively, when the peracid is PAP, it has a mean average particle size of between about 20 and about 50 microns. The peracid is may be present at a level of from about 0.1% to about 25%, alternatively from about 0.1% to about 20%, alternatively from about 1% to about 10%, alternatively from about 2% to about 4%. Alternatively, the peracid may be present at a much higher level of for example 10% to 40%, alternatively from 15% to 30%, alternatively from 15% to 25%.

The bleaching system may comprise photobleaches.

7. Additional Adjunct Actives a. Defoaming Agents

Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from about 0.001% to about 2% by weight of the composition, preferably from about 0.01% to about 1% by weight. A suitable defoaming agent is polydimethylsiloxane compounded with silica. Highly preferred compositions herein, unlike shampoos, are low-foaming, either through the specific addition of a suds suppressor, e.g., silica, PDMS, PDMS/silica dispersions and/or or fatty acid, or through intrinsic selection of a low-foaming cleaning system. In one embodiment, the fluid detergent composition is essentially free of skin moisturizing agents, and of gel forming polymers which are typically used in personal care compositions and/or shampoos. In other words, the fluid detergent compositions of the present invention do not encompass shampoo and personal care compositions.

8. Fluid Detergent Compositions

Water content: In one aspect, the fluid detergent compositions of the present invention are not anhydrous, but rather, contain up to a major portion of water. For example, the fluid detergent compositions of the present invention may comprise 5% by weight or more of water, more typically from about 5% to about 80% by weight composition of water. Other embodiments, such as for unit dose pouches, can contain 2% to 10% water. Yet other embodiments, for pouches or other concentrated fluids, can contain 5% to 15% water.

In other aspects, the fluid detergent compositions may contain only a minor portion of water, as described and exemplified below. In one embodiment, the fluid detergent composition has a low to nil amounts of water. In one embodiment the fluid detergent composition is preferably anhydrous having less than about 1%, or less than about 0.5%, or about 0% of water. In another embodiment, the fluid detergent composition comprises a water content of from about 0.01% to about 1%, alternatively from about 2% to about 10%, alternatively below 7%, alternatively below about 5%, alternatively from about 3% to about 5%.

pH: The fluid detergent compositions of the present invention may have a pH at 1% in deionized water of greater than about 6, alternatively greater than 7. The fluid detergent compositions may comprise surfactants that have a combined critical micelle concentration equilibrium surface tension value of less than 15 dynes/cm.

Isotropic and anisotropic fluid detergent compositions: When clarity of the fluid detergent composition is desired, it is preferred that the fluid detergent composition, in absence of the DPBA derivative, is isotropic.

It may also be advantageous to add the DBS derivative as an external structurant in anisotropic fluid detergent compositions, for instance in compositions comprising at least 2 distinct phases. Such compositions, comprising for instance an isotropic L1 surfactant phase and a lamellar surfactant phase dispersed therein, are often referred to as "internally structured" because they can exhibit suspending power if the surfactant system and the ionic strength of the composition are carefully adjusted. Adding the DBS derivative as an external structurant in these compositions presents the advantage of improving the physical stability of these compositions and their robustness against phase split upon storage. It also presents the additional advantage of allowing to modify the rheology of these compositions by simply tuning the level of the DPBA derivative, whilst avoiding sometimes delicate adjustments of the surfactants' type and level, and on the ionic strength components present in the detergent composition.

Organic Solvents:

The term "organic solvent" for formula accounting purposes herein does not include water. Suitable organic solvents for use in the present composition include monohydric alcohols, dihydric alcohols, polyhydric alcohols, glycerol, glycols, poly-alkylene glycols such as polyethylene glycol, and mixtures thereof. Highly preferred are mixtures of organic solvents, especially mixtures of lower aliphatic alcohols such as ethanol and/or diols such as 1,2-propanediol or 1,3-propanediol; or mixtures thereof with glycerol. Suitable alcohols especially include a $C_1$-$C_4$ alcohol.

In one embodiment the composition comprises perfume microcapsules or other encapsulated ingredients, and the composition relies on an organic solvent which is free from methanol and free from ethanol. Suitably this composition comprises a propanediol as sole organic solvent.

Other suitable organic solvents include a wide variety of hydrocarbons, ethers, ketones, glycol ethers, other lower polyhydric alcohols and the like. The organic solvent may be protic or aprotic and polar or nonpolar. Amines and alkanolamines or mixtures thereof may likewise be used, however for formula accounting purposes any solvent which can form a salt with an anionic component is reckoned as a pH adjuster. Suitable lower alkanolamines for use herein, for example for neutralizing surfactants provided to the plant in acid form, include monoethanolamine, diethanolamine, triethanolamine and mixtures thereof. The alkanolamine levels in the present compositions can range from 0.5 to 18% by weight, more typically from about 1% to about 10%.

The fluid detergent compositions can be concentrated liquids having less than 50% or even less than 40% by weight of organic solvent, alternatively less than 30% or even less than 25%. Organic solvent-free embodiments are not excluded, suitably the organic solvent is present at a level of at least 1%, at least 5% or even at least 10% or even at least 15% by weight of the composition. At least some amount of organic solvent is believed to be advantageous for the working of the invention, for example by moderating the polarity or diminishing the salt-carrying ability of any water present.

Other suitable organic solvents include: lower alcohols such as propanediol, diols, and combinations thereof. These organic solvents are typically included at a level of from about 1% to about 15% by weight, alternatively from about 2% to about 10%. In one preferable embodiment, the organic solvent consists essentially of diol solvents. In another embodiment, the organic solvent is free or essentially free of a polyol solvent.

Liquid detergent compositions according to the present invention can also be in a "concentrated form," in such case, the fluid detergent compositions according the present invention will contain a lower amount of water, compared to conventional liquid detergents.

Typically the water content of the concentrated fluid detergent composition is less than 40%, alternatively less than 30%, alternatively less than 20% by weight of the fluid detergent composition. Examples of particularly concentrated forms include examples where the water content is below about 15%, alternatively below about 10% by weight of water. These concentrated forms are suitable for gels or when the fluid detergent composition is used in a unit dose comprising a water soluble pouch or sachet. In a further aspect, the compositions may comprise from about 0.001% to about 10%, or from about 0.001% to about 6%, from about 0.001% to about 5%, or from about 0.001% to about 4%, or 0.001% to about 2%; or from about 0.01% to about 1% water. In a yet further aspect, the liquid detergent composition is substantially free of water.

9. Adjunct Ingredients

Preferred non-surfactant adjuncts include, but are not limited to, builders, chelants, dye transfer agents, dispersants, non-fabric substantive perfumes, filler salts, hydrotropes, photoactivators, photobleaches, opacifiers (such as styrene acrylate copolymers); hydrolyzable surfactants, perservatives, anti-oxidants, anti-shrinkage agents, anti-wrinkle agents, germicides, fungicides, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101.

One suitable type of builder is a fatty acid builder. Those of skill in the art will understand that fatty acids can be included for different purposes based on the relative amount of fatty acid used, said purposes include but not limited to functioning as a cleaning surfactant or as a builder. In one embodiment, the level of fatty acid is at a level of from 0.5% to 60% by weight, alternatively from 5% to 20% by weight. High solubility fatty acid mixtures can be used. Suitable fatty acids include C12-C18 saturated and/or unsaturated, linear and/or branched, fatty acids, or mixtures of such fatty acids. Additionally, mixtures of saturated and unsaturated fatty acids can be used, for example a mixture of rape seed-derived fatty acid and C16-C18 topped whole cut fatty acids, or a mixture of rape seed-derived fatty acid and a tallow alcohol derived 60 fatty acid, palmitic, oleic, fatty alkylsuccinic acids, and mixtures thereof. Branched fatty acids of synthetic or natural origin, especially biodegradable branched types can also be used.

Mixtures of any of these fatty acid builders can be advantageous to further promote solubility. It is known that lower chain length fatty acids promote solubility but this needs to be balanced with the knowledge that they are often malodorous, e.g., at chain lengths of C9 and below. While the term "fatty acid builder" is in common use, it should be understood and appreciated that as formulated in the present detergents, the fatty acid is in at least partially neutralized to neutralized form, the counter-ions can typically be alkanolamines, sodium, potassium, alkanolammonium or mixtures thereof. The fatty acids can be neutralized with alkanolamines such as Mono Ethanol Amine, and are fully soluble in the liquid phase.

10. Squeezable Dispensing and Bottom Dispensing Packages

In one aspect, the present composition is combined with a squeezable dispensing package. Such packages can be made from any known water-insoluble plastic, for example as disclosed hereinafter, and can be bottom-dispensing (as is the case for the package of Ariel Excel Gel, marketed in the UK in 2009), or can be top-dispensing. Such packages may offer especially desirable dispensing of concentrated fluid detergents of the invention when they are modified by the inclusion of a conventional slit valve. Bottom dispensing containers are nonlimitingly illustrated by Vangeel, EP 1870008A1 and Vangeel, WO 07/130,569A2.

11. Unit Dose

In another aspect, the fluid detergent composition is packaged in a unit dose pouch, wherein the pouch is made of a water soluble film material, such as a polyvinyl alcohol. In one embodiment the unit dose pouch comprises a single or multi-compartment pouch where the present fluid detergent composition can be used in conjunction with any other conventional powder or liquid detergent composition. Examples of suitable pouches and water soluble film materials are provided in U.S. Pat. Nos. 6,881,713, 6,815,410, and 7,125,828.

12. Article Comprising a Liquid Detergent Composition and a Substrate

In one aspect, an article for delivering a benefit to a fabric is disclosed. In this aspect, the article may comprise a liquid detergent composition as described herein and a substrate, wherein the composition may be in contact with the substrate. In this aspect, the liquid detergent composition is generally in the form of a gel, such as a thixotropic gel, as described above. In one aspect, the substrate may be fully or partially in the form of a film. In this aspect, the film may have a thickness of from about 0.01 mm to about 5.0 mm, or from about 0.1 mm to about 2.5 mm, or from about 0.3 mm to about 1.5 mm, more preferably from about 0.5 mm to about 1.0 mm.

In one aspect, the composition of the article may be in the form of a layer having a thickness as measured from the surface of the composition in contact with the substrate to the outer surface of the composition of from about 0.01 mm to about 0.3 mm, or from about 0.020 mm to about 0.2 mm, or from about 0.025 mm to about 0.1 mm, more preferably from about 0.03 mm to about 0.05 mm.

The substrate may be selected from the group consisting of water-soluble substrates, water-insoluble substrates, water dispersible substrates, water disintegrating substrates, and combinations thereof.

Suitable water-soluble substrates include polyvinyl alcohol (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum, polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohol copolymers, hydroxypropyl methyl cellulose (HPMC), or mixtures thereof. In one aspect, the water-soluble substrate may comprise polyvinyl alcohol. In a further aspect, the water soluble substrate may comprise a water-soluble substrate selected from the group consisting of cold-water soluble substrates, hot-water soluble substrates, and mixtures thereof. Applicants have found that use of the aforementioned DPBA derivates as a structurant at levels that provide thixotropic gel properties can be surprisingly achieved with water levels that are compatible with water-soluble films (i.e., does not dissolve or deform the films.)

Suitable water-insoluble substrate include water-insoluble substrates that may comprise polyethylene, polypropylene, polyamide, polyethylene terephthalate, polystyrene, polyurethane and/or its cross-linked product, sodium poly(meth) acrylic acid, poly(meth)acrylic acid ester and/or its cross-linked product, rubber such as ethylene rubber, propylene rubber, styrene-butadiene rubber, butadiene rubber, silicone rubber, and/or its cross-linked products, natural polymer, wovens, non-wovens, and mixtures thereof. The natural polymer may comprise cellulose, chitosan, starch, seed hulls, derivatives thereof, and combinations thereof.

Suitable dispersible substrates may include dispersible substrate that may comprise from about 0.01% to about 99%, from about 25% to about 80%, from about 30% to about 70%, from about 40% to about 50% of a water-insoluble substrate. In one aspect, the dispersible substrate comprises paper. Dispersible substrates include those disclosed in U.S. Pat. Publ. No. 2006/0293419 A1, published Dec. 28, 2006, U.S. Pat. No. 7,094,817, published Apr. 22, 2006, U.S. Pat. No. 6,211,309, published Apr. 3, 2001, and U.S. Pat. No. 5,224,601, published Jul. 6, 1993.

Suitable water-disintegrating substrates include those disclosed in Japanese Pat. Nos. 3525174 (Japanese Pat. Appl. No. H09-279457) and Japanese Pat. Appl. No. H10-008364, both assigned to Chisso Corp of Japan.

In some aspects, the substrate may comprise plasticizers, lubricants, release agents, fillers, extenders, anti-blocking agents, de-tackifying agents, antifoams, or combinations thereof.

In one aspect, a process of making an article for the localized treatment of a fabric is disclosed. In this aspect, the method may comprise the steps of a. obtaining a substrate;
b. providing a composition comprising from about 0.3% to about 2.0%, or from about 0.4% to about 1.0%, or from about 0.6% to about 0.9%, or from about 0.7% to about 0.8% of a DBS derivative;
c. extruding the composition onto the substrate.

One of ordinary skill in the art will recognize that the substrate and/or composition may take a variety of different forms as described above, and may be formed into a variety of different shapes. A process of making is exemplified in the Examples below.

In one aspect, a method of providing a benefit to a fabric is disclosed. In one aspect, the method may comprise the steps of:

a. Optionally pretreating and/or washing and/or rinsing the fabric;
b. contacting an article that may comprise a substrate as described herein and a composition as described herein with a fabric; and
c. optionally washing and/or rinsing the fabric.

In one aspect, the article may comprise a composition that imparts a stain removal benefit. In another aspect, the article may dissolve, partially or fully, during the washing and/or rinsing step. In another aspect, the article may comprise a substrate that may be insoluble in and/or may disperse during the wash or rinse step, which may be removed following the washing and/or rinsing step.

13. Composition Turbidity

In one embodiment, the fluid detergent composition is clear or transparent. As defined herein, when measuring the fluid detergent turbidity, the turbidity measurement is performed on the fluid portion of the composition. In one embodiment where a clear or transparent formulation is desired, the fluid matrix has a turbidity of from about 5 NTU to about 3000 NTU, alternatively less than about 1000 NTU, alternatively less than about 500 NTU, alternatively less than about 100 NTU.

In one embodiment, where a pearlescent composition is desired, the fluid detergent composition to which the pearlescent agent is added can be transparent or translucent, but may be opaque. Turbidity according to the present invention is measured using an Analyte NEP160 with probe NEP260 from McVan Instruments, Australia. In one embodiment of the present invention it has been found that even compositions with turbidity above 2800 NTU can be made pearlescent with the appropriate amount of pearlescent material. The Applicants have found however, that as turbidity of a composition is increased, light transmittance through the composition decreases. This decrease in light transmittance results in fewer of the pearlescent particles transmitting light, which further results in a decrease in pearlescent effect. The Applicants have thus found that this effect can to a certain extent be ameliorated by the addition of higher levels of pearlescent agent. However a threshold is reached at turbidity of 3000 NTU after which further addition of pearlescent agent may not improve the level of pearlescence.

In another embodiment, the invention includes a fluid detergent comprising a pearlescent agent such as coated or uncoated mica, bismuth oxychloride or the like in combination with a high level (such as from 1% to 7% by weight of the composition) of fabric care benefit agents such as substituted or unsubstituted silicones. The latter are incorporated into the composition in pre-emulsified form.

The fluid detergent compositions of the present invention may be packaged in any suitable packaging for delivering the fluid detergent composition for use. The package can be a clear or transparent pouch made of a soluble film as described herein. In another embodiment the package is a clear package made of glass or plastic. Suitable clear bottle materials with which this invention may be used include, but are not limited to: polypropylene (PP) including bi-oriented polypropylene (BoPP), polyethylene (PE), polycarbonate (PC), polyamides (PA) and/or polyethylene terephthalate (PETE), polyvinylchloride (PVC); and polystyrene (PS).

The transparent bottle according to the invention can have a transmittance of more than 25%, alternatively more than 30%, alternatively more than 40%, alternatively more than 50% in the visible part of the spectrum (approx. 410-800 nm). Alternatively, absorbency of bottle may be measured as less than 0.6 (approximately equivalent to 25% transmitting) or by having transmittance greater than 25% wherein % transmittance equals: ×100% absorbency For purposes of the invention, as long as one wavelength in the visible light range has greater than 25% transmittance, it is considered to be transparent/translucent. Measurement of the transmittance of the bottle is described in detail in WO 2000/036068.

14. Process of Making

The present invention also provides for a process of making a fluid detergent composition comprising the steps of (i) providing a premix comprising an external structurant comprising a DBS derivative and an organic carrier, and (ii) of combining the premix with a detergent feed to form a composition, said detergent feed comprising an anionic surfactant. In one embodiment, the external structurant further comprises a secondary structurant. In yet another embodiment, the second external structurant is provided in the detergent feed. In one embodiment, the step of providing the premix comprises a step of forming a premix.

It has importantly been found that the present structurant of DBS derivative does not need to be emulsified in step (i) of the above process. It has been found that by selecting an external structurant which does not need to be emulsified prior to introduction into the end product, a simplified and more flexible process of making is obtained. It has been reported that certain crystalline, hydroxyl-containing stabilizers such as those disclosed in U.S. Pat. No. 6,855,680 are processed by emulsifying the stabilizer in a premix with water. The present DBS derivatives, however do not need to be made into a emulsified form prior to addition into the fluid detergent composition.

It has importantly been found that the premix can be free or essentially free of water. This is a further substantial advantage over the crystalline, hydroxyl-containing stabilizers when structuring highly concentrated detergent compositions such as unit dose fluid detergent formulations packaged in polyvinylalcohol films, or when combining with water-soluble or water-dispersible substrates (as described below), where the water level in the composition needs to be strictly controlled. Moreover, concentrated fluid detergents in whatever packaged form all benefit greatly from the use of the inventive structurants and premixes having low (e.g., from 0 to about 5%) water levels.

Moreover in the process of the present invention, it is believed to be important that the organic medium in which the DBS derivative is dissolved to a sol or solution state should have an appropriate polarity so that it is capable of being homogeneously mixed with the balance of the composition. Hydrocarbon oils, for example, are believed to be insufficiently polar, so that the DBS derivative may not adequately structure the final composition when a premix comprising DBS and hydrocarbon is used in the present process. In contrast, PEG, glycols such as propylene glycols, and nonionic surfactants are of adequate polarity leading to uniform gel structure formation in the final detergent composition when these materials are used as carriers for the DBS derivative. In contrast with the inadequately polar hydrocarbons, water and water-surfactant mixtures (for example as used for forming structured detergents with castor oil derivatives) may be excessively polar, hindering the DBS derivative from forming a sol or solution prior to the premix being dispersed in the final composition, and thereby also hindering formation of the desired finely divided fibrillar structure.

In another embodiment, the process comprises the additional steps of (iii) cooling the composition of step (ii). In yet another embodiment, the process comprises the additional step of adding heat sensitive ingredients such as detersive enzymes when the step of cooling the composition brings the compositional temperature below the temperature where the heat sensitive ingredients are subject to decomposition.

Preferably, the organic carrier is an organic solvent described herein, a nonionic surfactant, or a mixture thereof. Preferably, the premix is free or essentially free of added electrolytes. Preferably, the premix is free or essentially free of water. In yet another embodiment, the anionic surfactant can be included in the organic carrier, but this is not necessary. In one embodiment, the premix is free or essentially free of anionic surfactant.

In one embodiment, the step of forming the structurant premix is performed at a temperature above which the said DBS derivative dissolves in the organic carrier (for instance above about 80° C., alternatively above about 95° C.). In one embodiment, the temperature at which the premix is performed is at least about 5° C., alternatively at least about 10° C. higher than the temperature at which all the DBS derivative is fully dissolved in the premix.

In another embodiment, the step of combining the structurant premix with the detergent feed is performed by adding the structurant premix at a temperature of at least 80° C., to the detergent feed heated up to a temperature of less than about 60° C., alternatively less than about 50° C. In another embodiment, the heat-sensitive ingredients, such as enzymes, perfumes, bleach catalysts, photobleaches, bleaches and dyes are added in the detergent feed after the structurant premix has been added therein, and the temperature is below 30° C.

In another embodiment, the process is conducted with the detergent feed further comprising a lipase enzyme.

Further, within the scope of the present invention is the use of DBS derivative or a premix as described above for incorporation into a laundry detergent composition.

The fluid detergent compositions of the present invention may be used in any step of an in-home laundering/fabric care process, such as through the wash or through the rinse in a conventional laundering process for finished garments, prewash or post-wash processes for finished garments, pre-wear or post-wear processes for finished garments.

15. Test Methods

Viscosity may be determined using a viscometer (Model AR2000, available from TA Instruments, New Castle, Del., USA), each sample is tested at a sample temperature of 25° C. using a 40 mm 2° steel cone at shear rates between 0.01 and 150 $s^{-1}$. Viscosities are expressed as units centipoise (cps) and are measured at rest and at a shear rate of 1 $s^{-1}$.

Water-Solubility 50 grams±0.1 gram of substrate material is added in a pre-weighed 400 ml beaker and 245 ml±1 ml of 25° C. distilled water is added. This is stirred vigorously on a magnetic stirrer set at 600 rpm for 30 minutes. The mixture is then filtered through a folded qualitative sintered-glass filter with a pore size of 20 microns. The water is dried off from the collected filtrate by any conventional method, and the weight of the remaining material is determined (which is the dissolved fraction). The % solubility is then calculated.

16. Examples

Example 1

A liquid laundry detergent composition according to the invention is prepared as follows:

Step 1:

A premix A1 is prepared by dissolving 3 grams DBS in 97 grams of 1,2 propanediol at 100° C.

Step 2: A premix B1 comprising the temperature-insensitive ingredients and having the composition described in Table 1 is prepared.

TABLE 1

Composition of premix B1

| Ingredient | Premix B1 grams |
|---|---|
| Linear Alkylbenzene sulfonic acid (LAS) | 12.0 |
| C12-14 alkyl ethoxy 3 sulfate Mono Ethanol Amine salt | 9.3 |
| C12-14 alkyl 7-ethoxylate | 8.0 |
| Citric acid | 3.0 |
| C12-18 Fatty Acid | 10.0 |
| Grease Cleaning Alkoxylated Polyalkylenimine Polymer[1] | 0.9 |
| PEG PVAc Polymer[4] | 0.9 |
| Soil Suspending Alkoxylated Polyalkylenimine Polymer[3] | 2.2 |
| Hydroxyethane diphosphonic acid | 1.6 |
| FWA | 0.23 |
| Ethanol | 1.5 |
| Boric acid | 0.5 |
| MEA | Up to pH 8 |
| Water up to | 66 grams |

Step 3: 10 grams of premix A1 heated up to 100° C. is mixed with 66 grams of premix B1 heated up to 60° C. at 400 rpm for 2 min, and the resulting mixture is let to cool down.

Step 4: When the temperature has dropped below 30 C, the heat-sensitive ingredients (1.5 gram protease, 0.7 gram amylase, 0.1 gram mannanase, 0.1 gram xyloglucanase, 0.4 gram pectate lyase and 1.7 gram of perfume) and 19.5 grams of deionized water are added under gentle stirring, at 300-400 rpm for 5 min, and the detergent composition is left to cool down to room temperature without any further agitation.

The resulting detergent composition is given as composition 1 in table 2.

TABLE 2

Liquid Detergent Composition

| | Detergent compositions | | | | | |
|---|---|---|---|---|---|---|
| Ingredient | 1 % | 2 % | 3 % | 4 % | 5 % | 6 wt % |
| Linear Alkylbenzene sulfonic acid | 12.0 | 12.0 | 12.0 | 12.0 | 12.0 | 10.2 |
| C12-14 alkyl ethoxy 3 sulfate MEA salt | 9.3 | 9.3 | 9.3 | 9.3 | 9.3 | — |
| Sodium C12-14 alkyl ethoxy 3 sulfate | — | — | — | — | — | 21.5 |
| C14-15 alkyl 7-ethoxylate | 8.0 | 8.0 | 8.0 | 8.0 | 8.0 | |
| C14-15 alkyl 8-ethoxylate | — | — | — | — | — | 1.6 |
| C12 alkyl dimethyl amine oxide | — | — | — | 0.2 | — | — |
| C12-14 alkyl hydroxyethyl dimethyl ammonium chloride | — | — | — | — | 0.2 | — |
| C12-18 Fatty acid | 10.0 | 10.0 | 10.0 | 10.0 | 10.0 | — |
| Citric acid | 3.0 | 3.0 | 3.0 | 3.0 | 3.0 | — |
| Grease Cleaning Alkoxylated Polyalkylenimine Polymer[1] | 0.9 | 0.9 | 0.9 | 0.9 | 0.9 | 2.6 |
| Alkoxylated Polyalkanolamine Polymer[2] | — | — | — | — | — | 2.6 |
| Ethoxysulfated Hexamethylene Diamine Dimethyl Quat | — | — | — | 0.2 | — | — |
| Ethoxylated Hexamethylene Diamine Dimethyl Quat | — | — | — | — | 0.3 | — |
| Soil Suspending Alkoxylated Polyalkylenimine Polymer[3] | 2.2 | 2.2 | 2.2 | 2.2 | 2.2 | — |
| PEG-PVAc Polymer[4] | 0.9 | 0.9 | 0.9 | 0.9 | 0.9 | — |
| Alkoxylated Polyalkylenimine Polymer[1] | — | 0.2 | — | — | — | — |
| Diethylenetriaminepenta(methylenephosphonic) acid | — | — | — | — | — | 0.6 |

TABLE 2-continued

| Liquid Detergent Composition | | | | | | |
|---|---|---|---|---|---|---|
| | Detergent compositions | | | | | |
| Ingredient | 1 % | 2 % | 3 % | 4 % | 5 % | 6 wt % |
| Hydroxyethane diphosphonic acid | 1.6 | 1.6 | 1.6 | 1.6 | 1.6 | |
| FWA | 0.23 | 0.23 | 0.23 | 0.23 | 0.23 | 0.4 |
| 1,2 Propanediol | 9.7 | 9.6 | 9.6 | 9.6 | 7.4 | 21.3 |
| Ethanol | 1.5 | 1.5 | 1.5 | — | — | — |
| Di Benzylidene Sorbitol[5] | 0.3 | 0.4 | 0.4 | 0.4 | 0.25 | 0.3 |
| Hydrogenated castor oil structurant | — | — | — | — | 0.25 | — |
| Boric acid | 0.5 | 0.5 | 0.5 | 0.5 | 0.5 | 1.3 |
| Perfume MicroCapsules | — | — | 0.9 | — | 0.9 | — |
| Perfume | 1.7 | 1.7 | 1.7 | 1.7 | 1.7 | 1.0 |
| Mica pearlescent agent | — | — | — | 0.04 | — | 0.05 |
| Monoethanolamine | To pH 8.0 | | | | | |
| Protease enzyme | 1.5 | 1.5 | 1.5 | 1.5 | 1.5 | 2.0 |
| Amylase enzyme | 0.7 | 0.7 | 0.7 | 0.7 | 0.7 | 0.7 |
| Mannanase enzyme | 0.1 | 0.1 | 0.1 | 0.1 | 0.1 | — |
| Cellulase enzyme | — | 0.1 | — | — | — | — |
| Lipase enzyme | — | 0.0341 | — | — | — | — |
| Xyloglucanase enzyme | 0.1 | — | — | — | — | — |
| Pectate lyase | 0.4 | 0.4 | 0.4 | 0.4 | 0.4 | — |
| Water and minors (antifoam, aesthetics, . . . ) | To 100 parts | | | | | |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxylate groups per —OH.
[3]600 g/mol molecular weight polyethylenimine core with 20 ethoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[5]Millithix 925S from Milliken

Example 2

Unit Dose Laundry detergent

A liquid laundry detergent composition according to the invention is prepared as follows:

Step 1: A premix A2 is prepared by dissolving 2 grams Di Benzylidene Sorbitol in 48 grams of 1,2 propanediol at 100° C.

Step 2: A premix B2 having the composition described in Table 3 is prepared.

TABLE 3

| Composition of Premix B2 | |
|---|---|
| Ingredient | % of base @100% active |
| Propane Diol | 10 |
| Citric Acid | 0.5 |
| MEA | 10 |
| Glycerol | 5 |
| Hydroxyethane diphosphonic acid | 1 |
| Potassium sulfite | 0.2 |
| C12-45 alkyl 7-ethoxylate | 20 |
| Linear Alkylbenzene sulfonic acid | 24.5 |
| FWA | 0.2 |
| C12-18 Fatty Acid | 16 |
| Ethoxysulfated Hexamethylene Diamine Dimethyl Quat | 2.9 |
| Soil Suspending Alkoxylated Polyalkylenimine Polymer[3] | 1 |
| $MgCl_2$ | 0.2 |
| Protease enzyme | 1.4 |

TABLE 3-continued

| Composition of Premix B2 | |
|---|---|
| Ingredient | % of base @100% active |
| Mannanase enzyme | 0.1 |
| Amylase enzyme | 0.2 |
| Water & minors | Up to 100% |

Step 3: 2 grams of Premix A2 is heated to 100° C. while Premix B2 is heated to 60° C. These 2 grams of Premix A2 are added to 38 grams of Premix B2 to provide a fluid detergent composition comprising 0.2% Di Benzylidene Sorbitol.

Step 4: After mixing at 400 rpm for 2 minutes, the resulting mixture is allowed to cool to room temperature.

The composition from Example 2 is then packed into Polyvinylalcohol pouches.

Example 3

A liquid laundry detergent composition having the properties of a thixotropic gel may be prepared as follows: A Premix A3 may be prepared by dissolving 2 grams of 100% DBS in 48 grams of 1,2 propanediol at 100° C. with mixing to form a 4% DBS Premix. A Premix B3 having the composition described in Table 4 is prepared. Premix A3 is heated to 100° C. and Premix B3 is heated to 60° C. Premix A3 is then added to Premix B3 in the amounts set forth in Table 5. After mixing at 400 rpm for 2 minutes the resulting mixture is allowed to cool to room temperature (20° C.). The 1.5 grams of the final mixture at room temperature is extruded onto a substrate that is a Monosol 1030 PVA film using a 2 mL syringe to form a 2"

by 2" patch. A polypropylene top sheet is applied to the top of the film. A film applicator is drawn across the top sheet. The patch is allowed to rest at room temperature for 24 hours before removing the top sheet.

Example 4

The procedure of Example 3 is carried out wherein the film is polyvinylalcohol based film created on a cellulosic-based (paper) substrate, such as that available from Dissolvo LLC (Croydon, Pa.).

Example 5

The procedure of Example 3 is carried out wherein the substrate is a dispersible, paper-based substrate in the form of a sheet.

TABLE 4

Composition of Premix B3

| Ingredient | % of base @100% active |
|---|---|
| Propane Diol | 10.043 |
| Citric Acid | 0.529 |
| Mono Ethanol Amine | 10.048 |
| Glycerol | 5.288 |
| 1-Hydroxyethylidene-1,1-Diphosphonic Acid | 1.058 |
| Potassium sulfite | 0.180 |
| Nonionic 24 EO7 | 20.146 |
| HLAS | 24.559 |
| Fluorescent Whitening Agent | 0.224 |
| Demineralized Water | 1.587 |
| TPK Fatty Acid | 16.394 |
| cationic polymer for soil removal | 2.910 |
| etholylated amine base polymer | 1.058 |
| $MgCl_2$ | 0.212 |
| protease (RM - 40.6 mg/g active) | 1.370 |
| Mannanase (RM - 25.0 mg/g active) | 0.136 |
| Natalase (RM - 29.26 mg/g active) | 0.165 |
| Water from raw materials | 3.421 |
| Impurities from raw materials | 1.153 |

TABLE 5

Example Compositions 6-9

| | Compositions 6-9 | | | |
|---|---|---|---|---|
| | 6 | 7 | 8 | 9 |
| Total DBS in Composition | 0.40% | 0.60% | 0.80% | 1.00% |
| Premix A3 (g) | 4.00 | 6.00 | 8.00 | 10.00 |
| Premix B3 (g) | 36.00 | 34.00 | 32.00 | 30.00 |

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid detergent composition comprising:

a. from about 0.01% to about 70% by weight of a surfactant system comprising an anionic surfactant or a mixture of anionic surfactant and nonionic surfactant, wherein the ratio of the weight percent of anionic surfactant to the weight percent of nonionic surfactant ranges from about 1:1 to about 100:1; and b. from about 0.01% to about 1%, by weight of the composition, of a dibenzylidene sorbitol acetal derivative; and c. from about 0.0001% to about 8% of a detersive enzyme comprising a lipase enzyme;

wherein the composition is a fluid and has a pH of from about 2 to about 10.5.

2. The fluid detergent composition of claim 1, wherein said fluid detergent comprises less than about 0.5%, by weight of the composition, of said dibenzylidene sorbitol acetal derivative.

3. The fluid detergent composition of claim 1, wherein said dibenzylidene sorbitol acetal derivative is selected from the group consisting of: 1,3:2,4-dibenzylidene sorbitol; 1,3:2,4-di(p-methylbenzylidene) sorbitol; 1,3:2,4-di(p-chlorobenzylidene) sorbitol; 1,3:2,4-di(2,4-dimethyldibenzylidene) sorbitol; 1,3:2,4-di(p-ethylbenzylidene) sorbitol; and 1,3:2,4-di(3,4-dimethyldibenzylidene) sorbitol.

4. The fluid detergent composition of claim 1, wherein said dibenzylidene sorbitol acetal derivative is selected from the group consisting of: a mono(3-chloro-4-methylbenzylidene)-D-sorbitol; a mono(3,4-dimethoxybenzylidene)-D-sorbitol; a mono(3-ethyl-4-methylbenzylidene)-D-sorbitol; a mono (3-methyl-4-ethylbenzylidene)-D-sorbitol; a mono(3-propyl-4-methylbenzylidene)-D-sorbitol; a mono(3,4-diethylbenzylidene)-D-sorbitol; a mono(3,4-dichlorobenzylidene)-D-sorbitol; a mono(3,4-dimethylbenzylidene)-D-sorbitol; a mono(3,4-dipropylbenzylidene)-D-sorbitol; a mono(3,4-diethoxybenzylidene)-D-sorbitol; a mono(3,4-diisopropoxybenzylidene)-D-sorbitol; a mono(3-ethyl-4-methylbenzylidene)-xylitol, a mono(3-methyl-4-ethylbenzylidene)-xylitol, a mono(3-propyl-4-methylbenzylidene)-xylitol, a mono(3,4-diethylbenzylidene)-xylitol, a mono(3,4-dichlorobenzylidene)-xylitol, a mono(3,4-dimethylbenzylidene)- xylitol, a mono(3,4-dipropylbenzylidene)-xylitol, a mono(3-chloro-4-methylbenzylidene)-xylitol, a mono(3,4-dimethoxybenzylidene)-D-xylitol, and mixtures thereof.

5. The fluid detergent composition of claim 1, wherein said dibenzylidene sorbitol acetal derivative has the formula:

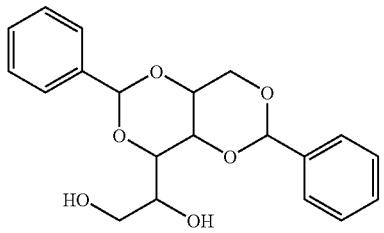

6. The fluid detergent composition of claim 1, wherein the detersive enzyme further comprises a cellulase enzyme, an endoglucanase enzyme, a hemicellulase enzyme, a peroxidase enzyme, a protease enzyme, a gluco-amylase enzyme, an amylase enzyme, a cutinase enzyme, a pectinase enzyme, a xylanase enzyme, a reductase enzyme, a oxidase enzyme, a phenoloxidase enzyme, a lipoxygenase enzyme, a ligninase enzyme, a pullulanase enzyme, a tannase enzyme, a pentosanase enzyme, a malanase enzyme, a β-glucanase enzyme, a arabinosidase enzyme, a mannanase enzyme, a xyloglucanases or a mixture thereof.

7. The fluid detergent composition of claim 1, wherein said fluid detergent further comprises from about 2% to about 10%, by weight of the composition, of water.

8. The fluid detergent composition of claim 7, wherein said fluid detergent further comprises from about 1% to about 15%, by weight of the composition, of an organic solvent.

9. The fluid detergent composition of claim 1, wherein said fluid detergent comprises less than 1%, by weight of the composition, of water.

10. The fluid detergent composition of claim 1, further comprising from about 0.1% to about 10%, by weight of the composition, of a fabric substantive agent selected from the group consisting of: silicon-moiety containing agents, anti-abrasion polymers, dye fixative agents, optical brighteners, fabric substantive perfumes, encapsulated fabric treatment actives, soil release polymers, photobleaches, bleaches, bleach precursors, and mixtures thereof.

11. The fluid detergent composition of claim 1, further comprising from about 0.01% to about 5%, by weight of the composition, of a suspension particle.

12. The fluid detergent composition of claim 1, further comprising a secondary structurant selected from the group consisting of coated or non-coated bacterial cellulase, non-polymeric crystalline hydroxyl-functional materials, polymeric structuring agents, and mixtures thereof.

13. The fluid detergent composition of claim 1, wherein the anionic surfactant is selected from the group consisting of $C_{11}$-$C_{18}$ alkyl benzene sulfonates, $C_{10}$-$C_{20}$ branched-chain and random alkyl sulfates, $C_{10}$-$C_{18}$ alkyl ethoxy sulfates wherein x is from 1-30, mid-chain branched alkyl sulfates, mid-chain branched alkyl alkoxy sulfates, $C_{10}$-$C_{18}$ alkyl alkoxy carboxylates comprising 1-5 ethoxy units, modified alkylbenzene sulfonate, $C_{12}$-$C_{20}$ methyl ester sulfonate, $C_{10}$-$C_{18}$ alpha-olefin sulfonate, $C_6$-$C_{20}$ sulfosuccinates, and mixtures thereof.

14. The fluid detergent composition of claim 1, wherein the nonionic surfactant is selected from the group consisting of $C_9$-$C_{18}$ alkyl ethoxylates, $C_6$-$C_{12}$ alkyl phenol alkoxylates, $C_{12}$-$C_{18}$ alcohol and $C_6$-$C_{12}$ alkyl phenol condensates with ethylene oxide/propylene oxide block polymers, $C_{14}$-$C_{22}$ mid-chain branched alcohols, $C_{14}$-$C_{22}$ mid-chain branched alkyl alkoxylates, alkylpolyglycosides, polyhydroxy fatty acid amides, ether capped poly(oxyalkylated) alcohols, fatty acid ($C_{12}$-18) sorbitan esters, and mixtures thereof.

15. The fluid detergent composition of claim 1, wherein said composition has a turbidity of less than about 1000 NTU.

16. The fluid detergent composition of claim 15, wherein said fluid detergent composition is at least partially enclosed in a package selected from the group consisting of a clear or transparent bottle and a clear or transparent pouch.

17. A fluid detergent composition comprising:

a. from about 0.01% to about 70% by weight of a surfactant system comprising an anionic surfactant or a mixture of anionic surfactant and nonionic surfactant, wherein the ratio of the weight percent of anionic surfactant to the weight percent of nonionic surfactant ranges from about 1:1 to about 100:1; and b. from about 0.01% to about 1%, by weight of the composition, of a dibenzylidene sorbitol acetal derivative;

wherein the composition is a fluid, has a pH of from about 2 to about 10.5, and further comprises from about 2% to about 10%, by weight of the composition, of water.

18. A fluid detergent composition comprising:

a. from about 0.01% to about 70% by weight of a surfactant system comprising an anionic surfactant or a mixture of anionic surfactant and nonionic surfactant, wherein the ratio of the weight percent of anionic surfactant to the weight percent of nonionic surfactant ranges from about 1:1 to about 100:1; and b. from about 0.01% to about 1%, by weight of the composition, of a dibenzylidene sorbitol acetal derivative;

wherein the composition is a fluid, has a pH of from about 2 to about 10.5, and further comprises from about 0.01% to about 5%, by weight of the composition, of a suspension particle.

* * * * *